United States Patent [19]

Hashimoto et al.

[11] Patent Number: 4,744,723

[45] Date of Patent: May 17, 1988

[54] METHOD FOR STARTING THERMAL POWER PLANT

[75] Inventors: Tsuguo Hashimoto; Taiji Inui, both of Hitachi, Japan

[73] Assignee: Hitachi, Ltd., Tokyo, Japan

[21] Appl. No.: 20,888

[22] Filed: Mar. 2, 1987

[30] Foreign Application Priority Data

Mar. 7, 1986 [JP] Japan ..... 61-49972

[51] Int. Cl.[4] ..... F04D 15/00

[52] U.S. Cl. ..... 415/145; 415/1; 60/646

[58] Field of Search ..... 415/1, 17, 26, 27, 28, 415/29, 145; 60/646, 656, 677

[56] References Cited

U.S. PATENT DOCUMENTS

| | | | |
|---|---|---|---|
| 3,623,324 | 11/1971 | Eggenberger | 415/1 |
| 4,003,205 | 1/1977 | Matsumura | 60/646 |
| 4,280,060 | 7/1981 | Kure-Jensen et al. | 415/17 |
| 4,309,873 | 1/1982 | Koran et al. | 60/464 |
| 4,353,216 | 10/1982 | Dickenson | 60/464 |

FOREIGN PATENT DOCUMENTS

| | | | |
|---|---|---|---|
| 905500 | 2/1982 | U.S.S.R. | 415/1 |
| 1058903 | 3/1986 | U.S.S.R. | 415/1 |

*Primary Examiner*—Robert E. Garrett

*Assistant Examiner*—John T. Kwon

*Attorney, Agent, or Firm*—Antonelli, Terry & Wands

[57] ABSTRACT

A thermal power plant includes a main system in which steam generated in a boiler passes, through a steam regulating valve, a high pressure turbine, a reheater and an intercept valve, into an intermediate pressure turbine and a low pressure turbine. The thermal power plant further has a high pressure bypass system bypassing the steam regulating valve and the high pressure turbine, and an intermediate and low pressure bypass system bypassing the intercept valve and the intermediate and the low pressure tubines. Upon starting the thermal power plant, the steam generated in the boiler is delivered, through the high pressure bypass system, the reheater and the intercept valve, into the intermediate and the low pressure turbines to accelerate the turbines, and after a sinchronous steam supply, the steam is delivered into the high pressure turbine through the steam regulating valve to increase a load imposed on the power plant instead of being delivered into the high pressure bypass system. The method for starting the thermal power plant is characterized in that an opening control of the steam regulating valve is conducted when a reheated steam pressure becomes equal to or lower than a predetermined pressure level as a result of opening of the intercept valve.

4 Claims, 2 Drawing Sheets

METHOD FOR STARTING THERMAL POWER PLANT

BACKGROUND OF THE INVENTION

The present invention relates to a method for controlling an operation of a steam turbine provided with a turbine bypass system. More particularly, it is concerned with a starting method for a thermal power plant, which is effectively applicable to a transient state from an intermediate pressure starting operational condition to a steam supply condition in which the steam is supplied to a high pressure turbine.

In recent turbine plants provided with turbine bypass systems, a part of the steam from a boiler has been often introduced into a turbine bypass system, thereby enabling a rapid start/stop operation and suppressing any thermal stress generated in the turbine. Such a plant has a high pressure turbine bypass system for bypassing steam to be introduced into a high pressure turbine and an intermediate turbine bypass system for bypassing steam to be introduced into intermediate and low pressure turbines. The turbine plant is started as follows:

I. BOILER IGNITION-TURBINE STEAM SUPPLY

Steam generated in the boiler flows through a high pressure turbine bypass system, a reheater within the boiler, a low pressure turbine bypass system and a steam condenser, in this order. The steam in this stage contains a great amount of moisture and is wet. This wet steam is not introduced into any of high, intermediate and low pressure turbines.

II. TURBINE STEAM SUPPLY-LOAD APPLICATION

When the steam from the boiler becomes a predetermined high temperature/high pressure steam, the steam is introduced into the low and the intermediate pressure turbines and the steam condenser through the high pressure turbine bypass system and the reheater. In this stage, the high pressure turbine is not supplied with steam, but an amount of the steam to be introduced into the low and intermediate pressure turbines is controlled by adjusting opening degrees of an intercept valve disposed at an inlet of the intermediate pressure turbine and of a low pressure bypass valve disposed in the low pressure turbine bypass system. This control causes the turbines to be driven at high speeds. When the speed of the turbines reaches rated speeds, a generator is coupled to a power system. The start condition of an operation in which only the intermediate and the low pressure turbines are used will be referred to as an "intermediate pressure starting" condition.

III. OPERATION UNDER LOAD

As the load is increased, the operation in which only the low and the intermediate pressure turbines are used is shifted to an operation in which not only the low and the intermediate pressure turbines but the high pressure turbine is used. Namely, a steam flow regulating valve provided at the inlet of the high pressure turbine is opened, so that the steam flowing through the high pressure turbine bypass system is introduced into the high pressure turbine. Finally, all of bypass valves incorporated with the turbine bypass systems are fully closed, and then the steam generated in the boiler flows into the condenser through the steam flow regulating valve, the high pressure turbine, the boiler reheater, the intercept valve and the intermediate and the low pressure turbines.

Although the intermediate starting method using the turbine bypass systems is very available for the high speed starting operation, in case of a shift of operation, i.e. from the intermediate pressure starting operation to the high pressure starting operation, the control of flow of the steam has been complicated unfortunately. More specifically, a "bottle-up" phenomenon (which causes an excessive thermal stress, an abnormal elongation difference, a vibration and the like due to the increased internal pressure of the high pressure turbine and an increased blow loss) is generated for a moment the steam regulating valve at the inlet of the high pressure turbine is opened and the steam introduced into the high pressure turbine reaches a predetermined flow rate. However, there has not been made any attempt to suppress the "bottle-up" phenomenon to a sufficiently low level in the prior art.

For instance, according to a technique shown in Japanese Patent Unexamined Publication No. 16210/1986, in order to keep a minimum possible flow rate needed for preventing the "bottle-up" phenomenon, a pressure of the reheated steam is detected, whereby the minimum possible flow rate-set value is determined. This value is compared with an actual load imposed on the high pressure turbine. Based upon the result of the comparison, the high pressure turbine steam flow rate is controlled so as to be increased relative to the reheated steam pressure that is a back pressure of the high pressure turbine. More specifically, the opening degree of the valve at the inlet of the turbine is adjusted so as to perform a load control of the turbine in response to a comparison signal. Alternatively, a replenish amount of fuel to be supplied into the boiler is adjusted so as to perform a control of the output of the boiler. Furthermore, if there is a fear that the "bottle-up" phenomenon would be generated even with such controls, the reheated steam pressure is decreased under limited conditions.

According to the method of the prior art, it would be possible to suppress the generation of the "bottle-up" phenomenon but a responsibility would be inferior. Thus, this could not meet the high speed starting operation. In addition, it would be difficult to cooperate the turbines and the boiler with each other. The conventional method is neither convenient nor practical.

SUMMARY OF THE INVENTION

In view of the above, an object of the present invention is to provide a method for starting a thermal power plant provided with a turbine bypass system for carrying out an intermediate pressure starting operation, which method is effective in suppressing a "bottle-up" phenomenon upon the introduction of steam into a high pressure turbine with a simplified arrangement.

To this end, according to the present invention, when main steam from a steam generator is introduced to the high pressure turbine during an intermediate pressure starting condition in which a reheated steam bypassing a high pressure turbine is introduced into an intermediate pressure turbine through an intercept valve, an opening degree of the intercept valve is increased in advance to decrease the reheated steam pressure, and thereafter, a steam regulating valve disposed at an inlet of the high pressure turbine is opened, so that an amount of steam to be introduced into the high pressure turbine is rapidly increased, and an adverse effect caused by the "bottle-up" phenomenon can be suppressed to a low level.

DESCRIPTION OF THE PREFERRED EMBODIMENT

Figure 1:
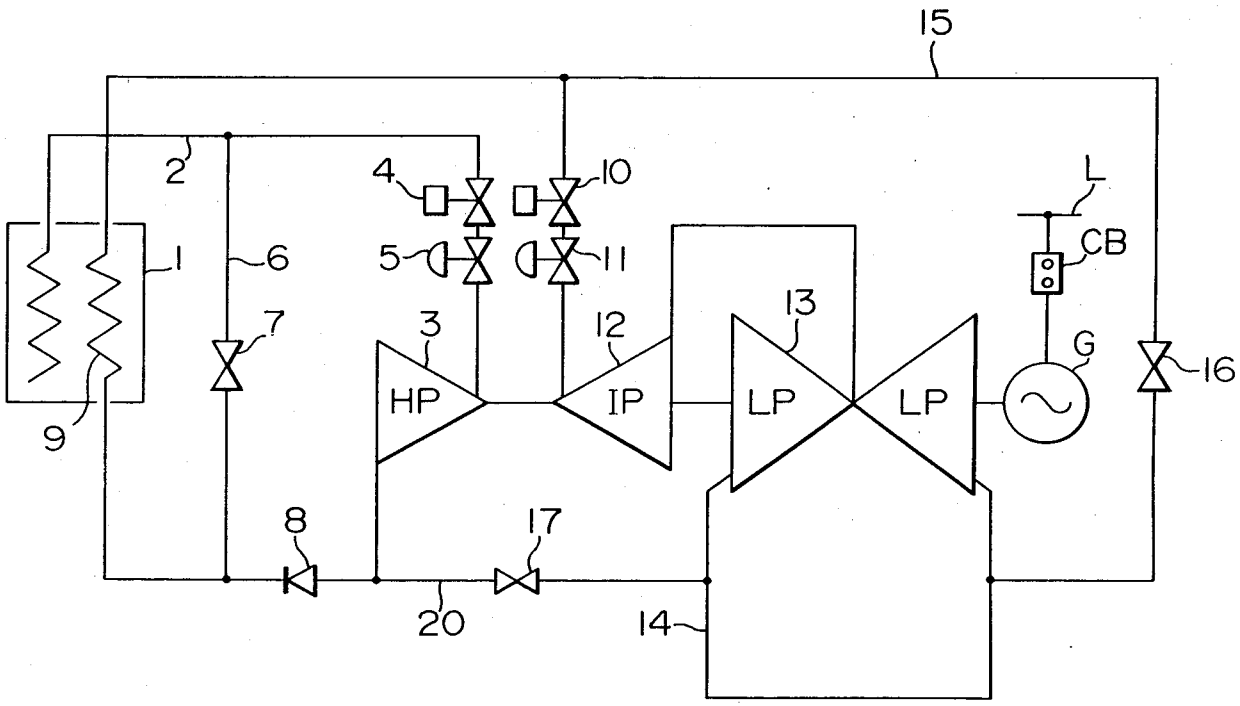
FIG. 1 is a systematic view showing a thermal power plant that is started at in an intermediate pressure starting manner.

FIG. 1 is a schematic view showing an arrangement of a thermal power plant with a turbine bypass system to which the invention is applied. In FIG. 1, the steam from a boiler 1 for generating the steam for driving a turbine is introduced into a high pressure turbine 3 through a conduit 2. A main steam stop valve 4 and a steam flow regulating valve 5 are interposed upstream of the high pressure turbine 3. Also, a bypass conduit 6 for bypassing the high pressure turbine 3 is connected to the conduit 2. A high pressure bypass valve 7 interposed in the bypass conduit 6 is opened or closed to bypass the main steam. An outlet passage of the high pressure turbine 3 is merged into the bypass conduit 6 through a check valve 8. The merged conduit is connected to a reheater 9 within the boiler 1 to reheat the steam. The reheated steam is introduced into an intermediate pressure turbine 12 through a reheated steam stop valve 10 and an intercept valve 11, and thereafter introduced into a steam condenser 14 through a low pressure turbine 13. Also, an excessive steam from the reheater 9 is discharged into the steam condenser 14 through a low pressure bypass valve 16 disposed in a bypass line 15 bypassing the intermediate pressure turbine 12 and the low pressure turbine 13. A ventilator valve 17 is provided in a passage 20 that connects the steam condenser 14 and the high pressure turbine 3 to each other, so that an interior of the high pressure turbine 3 is kept under a vacuum condition upon the plant is under an intermediate pressure starting condition.

The operation of the steam turbine plant thus arranged will be explained hereinunder with reference to FIG. 2 that shows an opening degree of each valves.

I. IGNITION OF BOILER 1 TO STEAM SUPPLY OF TURBINES

First of all, in an operation from the ignition of the boiler 1 to the steam supply of the turbines, a turbine bypass operation is carried out in which the high pressure and the low pressure bypass valves 7 and 16 are fully opened and the steam regulating valve 5 and the intercept valve 11 are fully closed.

Thus, the steam from the boiler 1 passes into the reheater 9 through the bypass conduit 6, and also passes into the reheater 9 through the low pressure bypass valve 16 and the condenser 14.

II. INTERMEDIATE PRESSURE STARTING STAGE

Under the condition that the high pressure turbine 3 is kept in a bypass state where the valve 7 is fully opened and the valve 5 is fully closed, in order to supply the reheated steam to the intermediate pressure turbine 12, the intercept valve 11 is opened to introduce the steam into the intermediate pressure turbine 12 and the low pressure turbine 13. This steam supply will cause the turbines to drive at increased speeds. The excessive reheated steam is returned back to the steam condenser 14 by means of opening the low pressure bypass valve 16. However, in order to supply the steam to the intermediate pressure turbine 12 through the intercept valve 11, the low pressure bypass valve 16 is throttled simultaneously with the steam supply to the turbine 12 so as to keep the reheated steam pressure constant. After the turbine speed has been sufficiently increased, a coupling means CB for coupling a generator G to a power system L is engaged to impose a load to the generator G. After the intermediate pressure starting control condition, i.e. the turbine steam supply, the speed increase and the load imposition, the main steam generated in the boiler 1 is supplied into the high pressure turbine 3 without any bypassing.

III. OPERATION UNDER LOAD

In order to supply the steam into the high pressure turbine 3 after the intermediate pressure starting condition, after a predetermined load has been reached (in general, over a rated load), the steam regulating valve 5 is opened. However, in order to avoid a temperature rise in the turbine exhaust, the following operation should be performed prior to the opening operation of the steam regulating valve 5. Namely, at a time $t_1$, the opening degree of the intercept valve 11 is increased toward the fully opened position so that the reheated steam pressure becomes or is lowered than a predetermined reheated steam pressure Pro. In this case, in conformity with the opening operation of the value 11, the low pressure bypass valve 16 is closed. Then, when the reheated steam pressure reaches the predetemined reheated steam pressure Pro (at time $t_2$), the steam regulating valve 5 is gradually opened, and simultaneously the high pressure bypass valve 7 is gradually closed. At the time $t_3$, a fully closed position of the high pressure bypass valve 7 is detected, thereby completing the turbine bypass operation. Subsequently, the steam regulating valve 5 is opened to increase the load. As described above, the steam regulating valve 5 is operated to be opened, on the basis of a detection signal of the reheated steam pressure, when the detection pressure is lowered below a predetermined pressure due to the increase in opening degree of the intercept valve 11.

According to the turbine operation control method, in order to avoid the temperature rise in the high pressure turbine exhaust, the intercept valve 11 is so opened that the reheated steam is lowered equal to or below the predetermined reheated steam pressure (a pressure at which a blow loss would not be generated), thereby reducing the reheated steam pressure upon the steam introduction into the high pressure turbine 3. This makes it possible to reduce a capacity of the low pressure bypass valve 16. Therefore, the low pressure bypass valve 16 may control a high reheated steam pressure, so that a flow rate of the high pressure turbine bypass flow under the intermediate pressure starting condition may be kept at a sufficiently high level.

Figure 2:
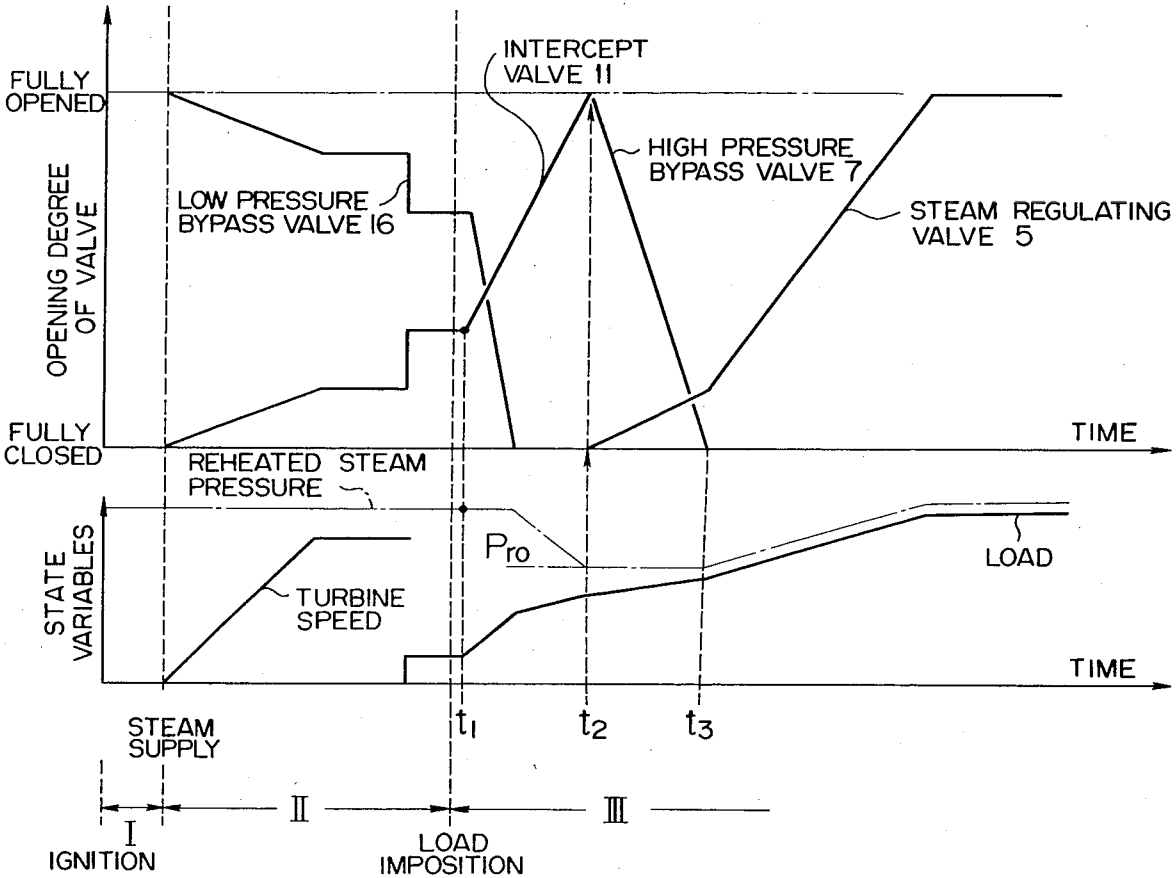
FIG. 2 is a diagram showing state variables and an opening degree of a valve in accordance with the present invention.

Incidentally, FIG. 2 shows an extreme example in which the steam regulating valve 5 is opened after the intercept valve 11 has been fully opened. However, if the reheated steam pressure prior to the opening operation of the steam regulating valve 5 is not greater than a predetermined level, it is unnecessary to further reduce the reheated steam pressure, it suffices that the steam regulating valve 5 is opened in a midway of the opening operation of the intercept valve 11.

As a modification of the present invention, instead of controlling the opening degree of the intercept valve 11 by detecting the reheated steam pressure, it may be possible to supply the steam to the high pressure turbine 3 under the fully opening condition of the valve 11 if the pressure at the fully open condition of the valve 11 is not greater than a predetermined level.

Also, the intercept valve 11 may be fully opened to reduce the reheated steam pressure, for the purpose of always introducing the reheated steam into at least the intermediate pressure turbine 12 prior to the steam supply to the high pressure turbine 3. In this case, of course the low pressure bypass valve 16 is urged toward the fully open position but it is fully closed if the reheated steam pressure becomes lower than a predetermined pressure by the opening operation of the intercept valve 11.

As has been fully explained, according to the present invention, upon supplying the steam into the high pressure turbine after the intermediate pressure starting condition, the intercept valve is utilized so that its opening degree is increased to reduce the reheated steam pressure and thereafter the steam regulating valve for the high pressure turbine is opened. Accordingly, the capacity of the low pressure bypass valve may be considerably reduced. In addition, by a simple operational control, the temperature rise of the high pressure turbine exhaust may be prevented advantageously.

What is claimed is:

1. In a method for starting a thermal power plant for delivering steam, generated in a boiler, through a steam regulating valve, a high pressure turbine, a reheater and a intercept valve, into an intermediate pressure turbine and a low pressure turbine, said thermal power plant having a high pressure bypass system for bypassing said steam regulating valve and said high pressure turbine, and an intermediate and low pressure bypass system for bypassing said intercept valve and said intermediate and said low pressure turbines, wherein upon starting said thermal power plant, said steam generated in said boiler passes through said high pressure bypass system, said reheater and said intercept valve into said intermediate and said low pressure turbines to accelerate the turbines, and after a synchronous steam supply, said steam passes into a high pressure turbine through said steam regulating valve to increase a load imposed on said power plant instead of passing into said high pressure bypass system, comprising a step of performing an opening control of said steam regulating valve under a condition that a reheated steam pressure becomes equal to or lower than a predetermined pressure level as a result of opening operation of said intercept valve.

2. A method according to claim 1, further comprising a step of closing a bypass valve disposed in said intermediate and low pressure bypass system in response to said opening operation of said intercept valve prior to said opening operation of said steam regulating valve.

3. In a method for starting thermal power plant for delivering steam, generated in a boiler through a steam regulating valve, a high pressure turbine, a reheater and a intercept valve, into an intermediate pressure turbine and a low pressure turbine, said thermal power plant having a high pressure bypass system for bypassing said steam regulating valve and said high pressure turbine, and an intermediate and low pressure bypass system for bypassing said intercept valve and said intermediate and said low pressure turbines, wherein upon starting said thermal power plant, said steam generated in said boiler passes through said high pressure bypass system, said reheater and said intercept valve into said intermediate and said low pressure turbines to accelerate the turbines, and after a synchronous steam supply, said steam passes into a high pressure turbine through said steam regulating valve to increase a load imposed on said power plant instead of passing into said high pressure bypass system, comprising a step of performing an opening control of said steam regulating valve under a condition that said intercept valve becomes fully opened.

4. A method for starting a thermal power plant comprising:

a first step of delivering steam generated in a boiler, through a high pressure bypass system bypassing a high pressure turbine and a steam regulating valve, a reheater, and an intermediate and low pressure bypass system bypassing an intercept valve and an intermediate pressure turbine and a low pressure turbine, into a steam condenser;

a second step of delivering said steam, through said high pressure bypass system, said reheater, said intercept valve through which a part of said steam passes, and said intermediate and said low pressure turbines, into said steam condenser; and a third step of delivering said steam, through said steam regulating valve, said high pressure turbine, said reheater, said intercept valve, and said intermediate and said low pressure turbines, into said steam condenser;

said method being characterized in that a shift from said second step to said third step is conducted under a condition that a pressure of the reheated steam becomes equal to or lower than a predetermined pressure level.

* * * * *